US005194706A

United States Patent [19]

Reneau

[11] Patent Number: 5,194,706

[45] Date of Patent: Mar. 16, 1993

[54] SHOCK SENSOR WITH A MAGNETICALLY OPERATED REED SWITCH

[75] Inventor: Daniel R. Reneau, Madison, Wis.

[73] Assignee: Hamlin, Inc., Lake Mills, Wis.

[21] Appl. No.: 745,070

[22] Filed: Aug. 14, 1991

[51] Int. Cl.[5] ..... H01H 35/14

[52] U.S. Cl. ..... 200/61.45 R; 200/61.45 M; 200/61.53; 335/205

[58] Field of Search ..... 200/61.45 R, 61.45 M, 200/61.49, 61.51, 61.53, 81.9 M, 82 E, 84 C; 335/203, 206, 207

[56] References Cited

U.S. PATENT DOCUMENTS

| | | | |
|---|---|---|---|
| 3,559,124 | 1/1971 | Posey | 335/205 |
| 3,795,780 | 3/1974 | Lawrie | 200/61.45 R |
| 3,853,199 | 12/1974 | Hirashima et al. | 180/274 |
| 4,016,535 | 4/1977 | Dinlocker | 340/440 |
| 4,117,430 | 9/1978 | Sims, Jr. | 335/205 |
| 4,518,835 | 5/1985 | Grossar | 200/61.45 M |
| 4,705,922 | 11/1987 | Seeger et al. | 200/61.45 M |
| 4,820,888 | 4/1989 | Shields | 200/61.45 M |
| 4,877,927 | 10/1989 | Reneau | 200/61.45 M |
| 4,980,526 | 12/1990 | Reneau | 200/61.45 M |

*Primary Examiner*—J. R. Scott

*Attorney, Agent, or Firm*—Lathrop & Clark

[57] ABSTRACT

A shock sensor has a housing defining an axially extending bore, a reed switch is centered within the bore by means of its axially extending leads and a transverse section of the housing which has an axially extending hole which centers one of the leads of the reed switch with the housing. The other lead of the reed switch is centered by a first retainer, which is fixed within the bore to align the reed switch within the housing with the axis of the housing. An activation magnet, is slidably mounted within the bore of the housing, and has a central hole passing over one of the axially extending leads. The magnet is biased by a spring away from the end activation region of the reed switch, which is near an end of the glass capsule which encloses the reed switch. The spring biases the activation magnet against a second retainer so that when the housing is not undergoing acceleration the activation magnet is biased to a position where the switch is not activated. The first and second retainers and perpendicular mounting leads are welded to the axial leads and are sealed from the atmosphere and joined to the bore of the housing by cast-in-place epoxy.

19 Claims, 2 Drawing Sheets

SHOCK SENSOR WITH A MAGNETICALLY OPERATED REED SWITCH

FIELD OF THE INVENTION

This invention relates to shock sensors in general and to shock sensors employing reed switches in particular.

BACKGROUND OF THE INVENTION

Shock sensors employing reed switches have been used in motor vehicles to detect a vehicle collision. When a collision occurs, the shock sensor triggers an electrical circuit for the actuation of safety devices such as inflating air bags, tensioning seat belts, and other similar systems. Such shock sensors typically employ a reed switch and an acceleration sensing magnet which is typically biased by a spring away from the central activation region of the reed switch, such that the reed switch is open when the shock sensor is not subject to acceleration. When the vehicle and the shock sensor, which is attached to the vehicle, are subjected to a crash-induced acceleration, the magnet, acting as an acceleration-sensing mass, moves relative to the central activation region so exposing the overlapping reeds to a magnetic field, causing them to mutually attract and close the reed switch.

Known shock sensors employing reed switches are typically considerably larger than the reed switch contained therein because of the necessity of packaging the activation magnet around or adjacent to the central activation region of the reed switch.

Because placement of the shock sensor within the automobile may be critical to its reliable and effective operation, packaging size of the overall shock sensor is important, in that a smaller sensor may be more readily placed in an effective location. Other known shock sensors have insufficient dwell times, especially in minimum crash situations, where the dwell time of the sensor may be zero.

What is needed is a shock sensor with extended dwell and extended minimum dwell, which is available in a physical package of smaller dimensions.

SUMMARY OF THE INVENTION

The shock sensor of this invention employs a housing defining an axially extending bore, the bore housing a reed switch which is centered within the bore by means of its axially extending leads and a transverse section of the bore which has an axially extending hole which centers one of the leads of the reed switch with the housing. The other lead of the reed switch is approximately centered by a first retainer, which is slid within the bore and affixed in place, so fixing the reed switch within the housing and aligned with the axis of the housing.

A shock sensor of this invention employs an activation magnet, which is slidably mounted within the bore of the housing, and has a central hole passing over one of the axially extending leads. The magnet is biased by a spring away from an end activation region of the reed switch, which is near the end of the glass capsule enclosing the reed switch. The spring biases the activation magnet against a second retainer so that when the housing is not undergoing acceleration, the activation magnet is biased to a position where the switch is not activated.

The first and second retainers, and the perpendicular mounting leads which may be welded to the axial leads, are sealed from the atmosphere and joined to the bore of the housing by cast-in-place epoxy. The shock sensor, which employs end activation, takes advantage of the increased pull-in/drop-out differential of end activation, which results in improved closure duration, increased minimum activation dwell time, and reduced mid-closure bounce.

It is an object of the present invention to provide a reed switch having improved closure duration.

It is another object of the present invention to provide a reed switch with improved minimum dwell time.

It is a further object of the present invention to provide a shock sensor with reduced mid-closure bounce.

It is also an object of the present invention to provide a shock sensor with improved packaging dimensions.

It is yet another object of the present invention to provide a shock sensor which is designed for self-alignment of the components during assembly.

Further objects, features and advantages of the invention will be apparent from the following detailed description when taken in conjunction with the accompanying drawings.

DESCRIPTION OF THE PREFERRED EMBODIMENT

Figure 5:
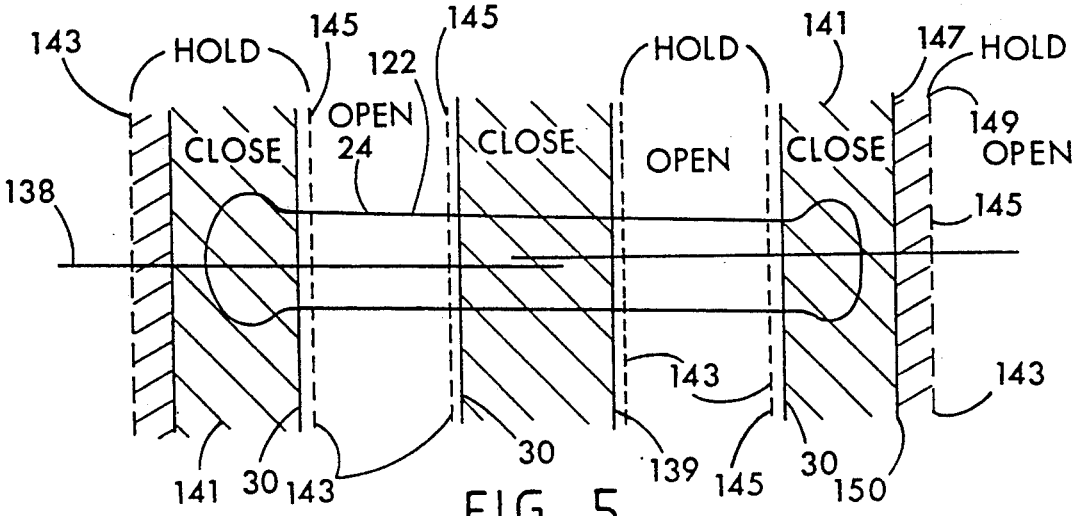
FIG. 5 is a schematic view of a reed switch showing the pull-in and drop-out regions associated therewith.

Referring more particularly to FIGS. 1–5, wherein like numbers refer to similar parts, a shock sensor 20 is shown in FIGS. 1–4. The shock sensor 20 employs a reed switch 22 which is comprised of a glass capsule 24 and two enclosed reeds 26. The reeds have contact areas 28 which overlie one another and which may be brought into contact by application of a magnetic field to activation regions 30, as shown in FIG. 5, which are defined by the characteristics of the reed switch 22 and the shape of the activating magnetic field. The reeds 26 are connected to axially extending leads 68, 32 which pass through a hermetic seal 34 in the ends 36, 64 of the glass capsule 24, best shown in FIGS. 3 and 4. The axial leads 68, 32 define an axis 38 of the reed switch 22.

Figure 1:
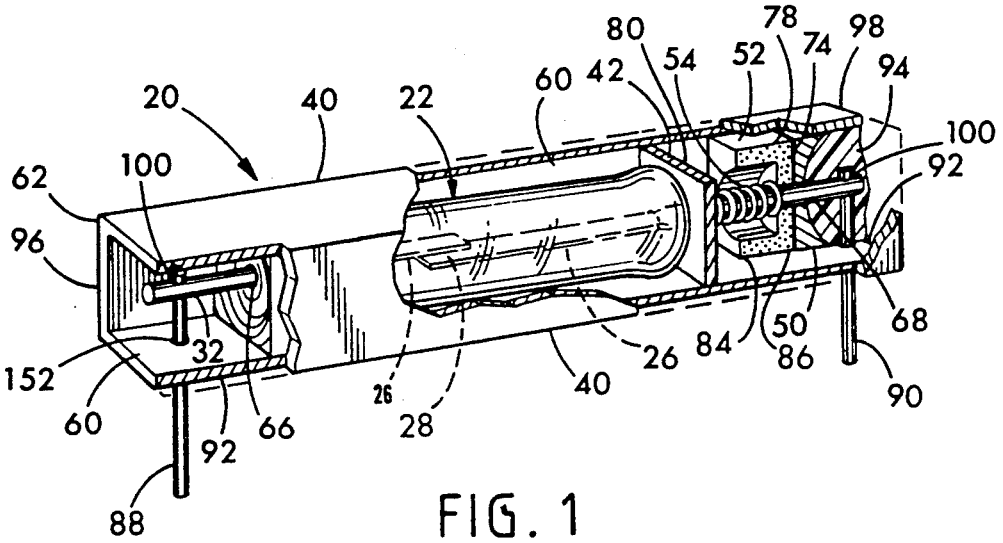
FIG. 1 is a front isometric view partly cut away of the shock sensor of this invention.
Figure 2:
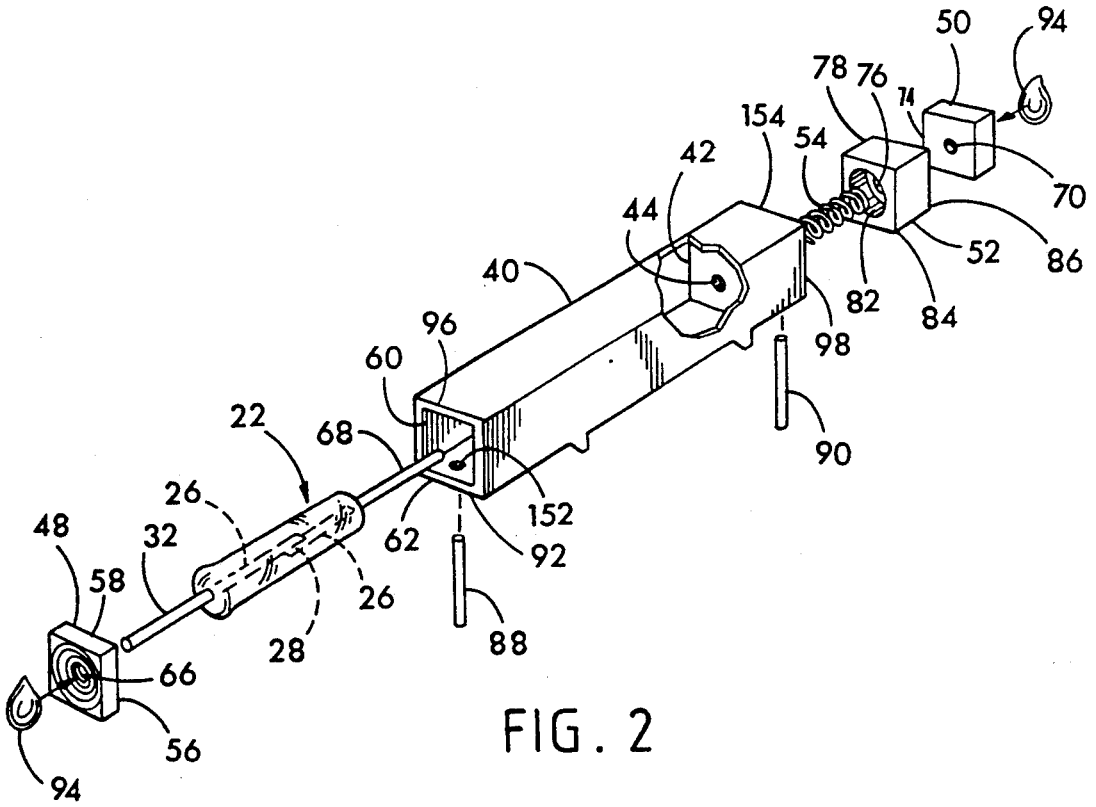
FIG. 2 is a perspective exploded view of the shock sensor of FIG. 1.
Figure 3:
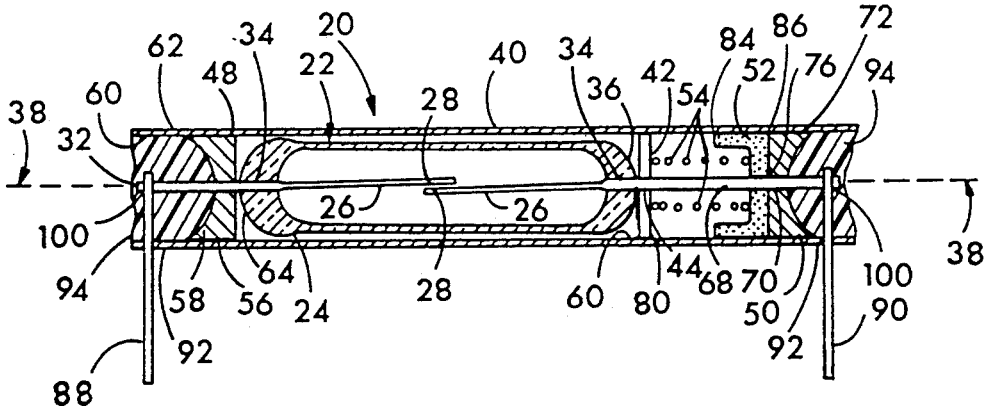
FIG. 3 is a side cross sectional view of the shock sensor of this invention shown while it is not undergoing acceleration.
Figure 4:
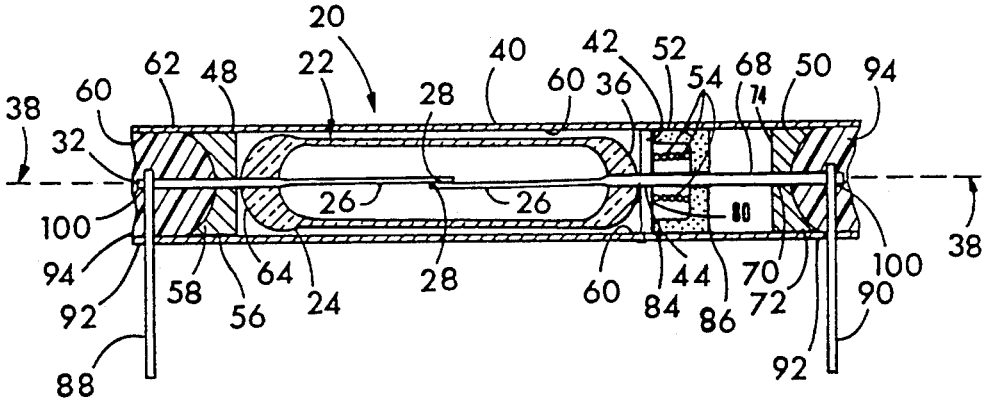
FIG. 4 is a cross-sectional view of the shock sensor of FIG. 3 shown undergoing acceleration.

The reed switch 22 is mounted in a housing of rectangular cross section, shown in FIGS. 1 and 2. The housing 40 has a transverse wall portion 42 which extends transverse to the axis of the reed switch 22 and the housing 40. The transverse portion 42 forms a centering wall which has a central hole 44 which serves to center and accurately position the reeds 26 of the reed switch 22 with respect to the housing 40.

The glass capsule 24 which surrounds the reeds 26 is, in general, not a high-tolerance part, due in part to the deformation the glass undergoes when it is heated to form the hermetic seals 34 where the leads 68, 32 penetrate the ends 36, 64 of the glass capsule. The leads 68, 32 are integrally manufactured with the reeds 26 and are designed to high tolerances. As a result of this accuracy of manufacture, the position of the overlapping contact areas 28 with respect to the leads 68,32 is known. The alignment between the leads 68,32 and the reeds 26 and their contact areas 28 are used advantageously in the assembly of the shock sensor 20 to simply and precisely align the reed switch 22 with the housing 40 and the other components of the shock sensor 20.

The other components of the shock sensor 20 are two opposed retainers 48, 50, an actuation magnet 52, and a biasing spring 54. The opposed retainer 48 has an outside surface 56 and a body 58 which extends transverse to the axis 38 of the housing 40 and occludes the bore 60 of the housing 40 in a manner similar to the centering wall 42 and is positioned within the bore 60 on the side 62 of the reed switch 26 opposite the centering wall 42 and is abutted by the reed switch end 64.

The opposed retainer 48 has a central hole 66 which is centered along the axis 38 of the housing 40 and together with the centering wall 42, centers the reed switch within the housing 40. The lead 68 which passes through the centering wall 42 serves as a guide and as a centering retainer for the biasing spring 54. The magnet 52 which may be slidably mounted in the bore 60 of the housing 40 is slidably mounted coaxially with the reed switch 22 and the lead 68 which penetrates the centering wall 42. The biasing spring 54 extends between the actuation magnet 52 and the centering wall 42 and biases the magnet against a retainer 50. The retainer 50 has a centering hole 70 and an outside surface 72 which engages the bore 60 of the housing 40. The retainer 50 centers the lead 68 along the axis of the housing 40 and defines a second abutment 74 against which the magnet 52 is biased by the spring 54.

The magnet 52 has a central hole 76 through which the lead 68 passes and has an outer peripheral surface 78 which may be slidably engaged with the bore 60 of the housing 40. The magnet 52 has a central cylindrical depression 82 which is dimensioned to surround the spring 54 and which opens towards the end 64 of the reed switch 22. Under an applied acceleration along the axis 38 of the housing 40, the magnet will slide away from engagement with the second abutment 74 of the second retainer 50 towards a first abutment 80 which faces away from the capsule and which is defined by the centering wall 42, best shown in FIG. 4. When the actuation magnet 52 abuts the centering wall 42, the spring 54 is contained within the central depression 82 of the magnet 52. The magnet 52 will preferably be of a type having a north pole 84 and a south pole 86 aligned with the axis 38 of the housing 40 to effect the actuation of the reed switch 26 when the housing 40 undergoes an axial acceleration.

Mounting leads 90, 88 penetrate the wall 92 of the housing 40 and are joined, preferably by welding, to the axially extending leads 68, 32. The entire shock sensor 20 may be hermetically sealed by a cast-in-place material 94, preferably epoxy, which seals the ends 96, 98, of the bore 60 of the housing 40. The epoxy 94 serves to affix the retainers 48, 50 to the bore 60 of the housing 40 and to encapsulate the welds 100 joining the mounting leads 90 to the axially extending leads 32.

The shock sensor 20 may be advantageously employed as a shock sensor for initiating emergency equipment in a car during a crash. Shock sensors 20 in cooperation with electronic circuitry may, for instance, initiate the deployment of air bags when a sensor 20 detects an acceleration of sufficient severity to indicate deployment of the air bags is necessary for the safety of the occupants of the vehicle. To function properly and to prevent improper or spurious activation of safety equipment, a number of shock sensors are normally employed. These shock sensors will be located on portions of the vehicle which engineering design or testing has indicated that the shock sensors will be subject to characteristic loads indicative of the severity of the crash. Because the mounting locations are often small and in areas of limited access, the small package size, such as is available in the shock sensor 20, is of paramount importance. The shock sensor, because it forms part of a safety system, must have high reliability and uniformity of action. Reed switches 26 employed in shock sensors 20 are an inherently highly reliable device. The design of the shock sensor 20 which has a reed switch 26 aligned with the housing 40 and the activation magnet 52 also aligned with the housing 40, produces a low-cost shock sensor 20 wherein the components are precisely aligned for repeatability of actuation.

In the automotive industry of where millions of cars and tens of millions of shock sensors may be used every year, large savings are realized through the use of a shock sensor 20 which can meet the requirements of reliability and uniformity of actuation while reducing the cost of the individual sensor.

A reed switch 122 as shown in FIG. 5, has three activation regions when actuated by a magnet with poles aligned along the axis 138. These comprise a central region 139 and two end regions 141. These regions 30 indicate magnet positions along the axis 138 which will close the reed switch. In addition to the closure region, hold regions 143 are shown in FIG. 5. The hold regions 143 indicate where the reed switch 122 will remain closed as the activation magnet moves from a closed region 141 to an open region 145. The hold region represents the difference between the pull-in position 147 and the drop-out position 149, where the reed switch 122 will open as the activation magnet is moved away from the end region 141. The differential between the pull-in position 147 and the drop-out position 149 of a reed switch is greatest for the outside 150 of the end closure region 141. Typical shock sensors utilize the central region 139 where the reeds overlap and have small pull-in/drop-out differentials as shown in FIG. 5. The reed switch 20 utilizes the end activation region with the activation magnet 52 moving through the outside end 150 of an end region 141. This results in greater pull-in/drop-out differential which is favorable to closure duration and mid-closure bounce.

Closure duration is increased because the shock sensor remains activated from the time the activation magnet enters the closure region until it leaves the hold region 143. This results in a shock sensor with a greater dwell time which simplifies the detecting circuitry and improves the reliability of the detection of a crash-produced acceleration.

The favorable increased pull-in/drop-out differential of the end region also decreases the probability that the shock sensor will open prematurely as the actuation magnet 52 bounces off the second abutment on the reed centering wall because of the greater distance the magnet 52 must travel during the bounce before the reed switch 22 will open.

In a minimum crash situation where the activation magnet is subject to an acceleration just sufficient to move it into an activation region, the activation time of the sensor will be small or zero. However, in the shock sensor 20, the greater pull-in/drop-out differential of the end region results in a shock sensor which will have extended minimum dwell time, which results as the magnet 52 moves through the extended hold region 143.

The assembly of the shock sensor 20 is facilitated by the packaging design best shown in FIGS. 1 and 2. As shown in FIG. 2, assembly is initiated by sliding the reed switch 22 into the housing 40, passing one of the axial leads 68 through the hole 44 in the centering wall 42 until the end 36 of the glass capsule abuts the centering wall 42, thus aligning the abutting end 36 with the axis 38 of the housing. Next, the first retainer 48 is slid over the lead 32 opposite the lead 68 and the centering wall 42. The first retainer 48 will preferably have a frictional fit between the outside surface 56 of the first retainer 48 and the bore 60 of the housing 40. The first retainer is slid forward towards the centering wall until it abuts the end 64 of the glass capsule, so holding the reed switch 22 in a fixed position within the housing 40 with the axis of the reed switch 22 aligned with the axis of the housing 40. Next, the biasing spring 54 is placed over the axially extending lead 68 at the shock sensing end of the reed switch 22, followed by the activation magnet/acceleration-sensing mass 52, which slidably engages the bore 60 of the housing 40.

The spring 54 and the magnet 52 are retained by a second retainer 50 similar in all respects to the first retainer 48, and preferably also having a frictional engagement with the bore 60 of the housing 40. The second retainer may be accurately positioned within the bore 60 of the housing 40 by a plunger or the like (not shown), which gauges the depth of the second retainer 50 within the bore 60 of the housing 40 and which positions the second retainer 50 a fixed distance from the centering wall 42. The mounting leads 88, 90 are then passed through mounting lead holes 152 and welded or otherwise affixed to the axial leads 32, 68. The ends 96, 98 of the housing 40 are then sealed by epoxy 94 which forms a hermetic seal and affixes the retainers 48, 50 and the mounting leads 88, 90 to the housing 40.

The housing 40 and the retainers 48, 50, may advantageously be made of injection-molded plastic. The magnet 52 will preferably be made of a magnetizable material dispersed in a plastic matrix so that it, too, may be manufactured by injection molding. Because the shock sensor 20 embodies self-aligning features, in that the assembly of the shock sensor aligns the reed switch 22 with the housing 40 and the actuation spring 54 and magnet 52 are aligned by the axial lead 68 and the bore 60 of the housing 40, the shock sensor 20 may be readily assembled with tight tolerances at reasonable costs and without excessive fixturing.

Although the housing 40 is shown as square in cross section, it should be understood that it may be circular, triangular, or other suitable shape. Although a spring is shown biasing the activation magnet 52 away from the first abutment 80, other means of biasing such as a pneumatic piston or a biasing magnet could be employed.

It is understood that the invention is not confined to the particular construction and arrangement of parts herein illustrated and described, but embraces such modified forms thereof as come within the scope of the following claims.

I claim:

1. A shock sensor comprising:

a) a housing;

b) a reed switch having a glass capsule defining an axis with at least one reed disposed along the axis and the capsule having a first end and a second end, wherein the reed switch is mounted within the housing;

c) a first abutment fixed to the housing in proximity to the capsule first end and facing away from the capsule;

d) a second abutment spaced axially away from the capsule, and spaced from the first abutment;

e) a magnet slidably mounted within the housing between the first and second abutments;

f) a load-responsive means for biasing the magnet, said means being mounted between the first abutment and the magnet and adapted to bias the magnet away from the first end of the reed switch while the shock sensor is not subjected to a selected accelerative force; and to allow the magnet to approach the first end of the reed switch when the sensor is subjected to a selected accelerative force.

2. The shock sensor of claim 1 wherein the reed switch has at least one lead extending axially from the first end, and wherein the magnet has portions defining a central hole and is slidably axially mounted within the housing such that the lead extends axially through the central hole.

3. The shock sensor of claim 1 wherein the first abutment is intermediate between the second abutment and the capsule first end.

4. A shock sensor comprising:

a) a reed switch having a glass capsule defining an axis with at least one reed disposed along the axis and the capsule having a first end and a second end;

b) a tubular housing which extends along the reed switch axis, wherein the housing has a housing transverse portion extending perpendicularly to the axis of the reed switch, the transverse portion having portions defining an axially extending hole, and wherein the reed switch is mounted on the housing;

c) at least one lead extending from the first end of the reed switch, the lead extending through the hole in the transverse portion of the housing, and the first end of the reed switch abuts the transverse portion;

d) a first abutment fixed to the housing in proximity to the capsule first end and facing away from the capsule;

e) a second abutment spaced axially away from the capsule, and spaced from the first abutment;

f) a magnet slidably mounted to the housing between the first and second abutments;

g) a spring mounted coaxially with the lead, and located between the transverse portion and the magnet, the spring being mounted between the first abutment and the magnet and adapted to bias the magnet away from the first end of the reed switch while the shock sensor is not subjected to a selected accelerative force; and to allow the magnet to approach the first end of the reed switch when the sensor is subjected to a selected accelerative force; and h) portions of the magnet defining a central hole wherein the magnet is axially mounted on the lead with the lead passing through the central hole, so that the first end of the reed switch, the housing, the spring, and the magnet are all axially aligned.

5. The shock sensor of claim 4 further comprising a first retainer rigidly mounted to the housing, extending transverse to the axis of the housing, and having a central axis hole through which the lead of the reed switch passes, the retainer being spaced from the transverse portion of the housing and distal from the first end of the reed switch, and abutting the magnet so that the first retainer forms a first abutment with the spring biasing the magnet against the first abutment and the magnet being slidable along the axis defined by the lead between the first abutment and a second abutment formed by the transverse portion of the housing when the housing undergoes acceleration along the axis of the reed switch.

6. The shock sensor of claim 5 wherein the reed switch has at least one second lead extending from the second end of the reed switch, and further comprising a second retainer, the retainer having portions defining a central axial hole wherein the second retainer abuts the second end of the reed switch and centers the second lead with the axis of the housing, the second retainer being affixed to the housing so positively retaining the reed switch on the housing.

7. The shock sensor of claim 6 wherein the housing and the first and second retainers form a container which is hermetically sealed.

8. The shock sensor of claim 7 wherein a hermetic seal is formed by a cast-in-place material which surrounds the first and second leads and affixes the first and second retainers to the housing.

9. The shock sensor of claim 8 wherein the cast-in-place material is epoxy.

10. A shock sensor having an improved minimum dwell time comprising:

a) a housing defining an axis, the housing having a transverse portion, the portion having a hole along the axis of the housing;

b) a reed switch mounted along the axis of and within the housing and having a first end and a second end, the first end having a first axially extending lead, the first lead passing through the axial hole in the transverse portion of the housing so centering the reed switch, the first end of the reed switch being adjacent to the transverse portion, wherein the transverse portion is interposed between the magnet and the reed switch, such that the transverse portion prevents the magnet from occupying a position surrounding the reed switch; and c) a magnet having portions defining a central hole, wherein the first lead passes through the central hole in the magnet, the magnet being slidably mounted about the first lead, the reed switch being responsive to the position of the magnet such that the reed switch is activated when the magnet travels to a pre-selected activation position adjacent to the first end of the reed switch in response to an acceleration force applied to the housing.

11. The shock sensor of claim 10 further comprising a second lead axially extending from the second end and a retainer centered about the second lead for centering the reed switch within the housing.

12. The shock sensor of claim 10 further comprising a biasing means between the transverse portion of the housing and the magnet so biasing the magnet distal from the first end of the reed switch and the pre-selected activation region.

13. The shock sensor of claim 10 further comprising an abutting retainer which is mounted coaxial to the first lead and the housing in fixed relation and being distal from the first end of the reed switch and abutting the magnet when it is biased away from the pre-selected activated position.

14. A shock sensor comprising:

a) a housing having linearly extending walls defining a bore and an axis;

b) a reed switch spaced within the bore having a first end and a first axially extending lead extending from the first end, the first lead being centered in the bore by a transverse extending portion of the housing which defined an axially extending hole through which the first lead passes;

c) a magnet slidably mounted in the bore of the housing between a first position proximal to the first end of the reed switch and a second position distal from the first end of the reed switch, the magnet having a north pole and a south pole aligned with the axis of the bore; and

15. The shock sensor of claim 14 further comprising a retainer fixedly mounted within the bore of the housing, and having portions defining a central hole aligned with the axis of the housing, wherein the reed switch has a second axially extending lead extending from a second end of the reed switch of said second lead passes through the hole in the retainer, and where the retainer abuts the reed switch wherein the reed switch is fixedly held by the first and second axially extending leads along the axis of the housing and is affixed along the axis by the transverse portion of the housing and the retainer.

16. The shock sensor of claim 15 further comprising a second retainer mounted in the bore of the housing, the second retainer having portions defining a central hole, the second retainer being spaced about the first axially extending lead and forming an abutment distal from the first end of the reed switch.

17. The shock sensor of claim 14 wherein the bore has two ends and an inside surface further comprising a castable material occluding the ends of the bore and adhering to the inside surface of the bore, so hermetically sealing the shock sensor.

18. A shock sensor of claim 14 further comprising:

a) a second axially extending lead, extending from a second end of the reed switch; and b) two mounting leads connected to the first and second axially extending leads at approximately right angles, for mounting the shock sensor.

19. A shock sensor comprising:

a) a housing;

b) a reed switch having a glass capsule defining an axis with at least one reed disposed along the axis and the capsule having a first end and a second end, wherein the reed switch is mounted on the housing;

c) a first abutment fixed to the housing in proximity to the capsule first end and facing away from the capsule;

d) a second abutment spaced axially away from the capsule, and spaced from the first abutment;

e) a magnet slidably mounted to the housing between the first and second abutments such that the first abutment is intermediate between the second abutment and the capsule first end;

f) a load-responsive means for biasing the magnet, said means being mounted between the first abutment and the magnet and adapted to bias the magnet away from the first end of the reed switch while the shock sensor is not subjected to a selected accelerative force; and to allow the magnet to approach the first end of the reed switch when the sensor is subjected to a selected accelerative force.

* * * * *

UNITED STATES PATENT AND TRADEMARK OFFICE

CERTIFICATE OF CORRECTION

PATENT NO. : 5,194,706

DATED : March 16, 1993

INVENTOR(S) : Reneau

It is certified that error appears in the above-indentified patent and that said Letters Patent is hereby corrected as shown below:

Column 4, line 21, "industry of where" should be --industry, where--

Column 6, line 67 and 68, "central axis hole" should be --central axial hole--

Column 8, line 15, insert --d) a spring located in the bore of the housing between the first end of the reed switch and the magnet, the spring biasing the magnet to the second position distal from the end of the reed switch so that when the housing is subjected to acceleration along the axis of the housing from the first end of the reed switch towards the magnet, the magnet will move against the biasing spring to the first position proximal to the first end of the reed switch, so causing the activation of the switch.--

Column 8, line 39, "A shock sensor" should be --The shock sensor--

Signed and Sealed this

Thirtieth Day of July, 1996

*Attest:*

BRUCE LEHMAN

*Attesting Officer*

*Commissioner of Patents and Trademarks*